US009335692B1

(12) United States Patent
Sawamura et al.

(10) Patent No.: US 9,335,692 B1
(45) Date of Patent: May 10, 2016

(54) FIXING DEVICE, IMAGE FORMING APPARATUS, PRESSING DEVICE, AND URGING DEVICE

(71) Applicant: FUJI XEROX CO., LTD., Tokyo (JP)

(72) Inventors: Jun Sawamura, Kanagawa (JP); Hideki Sato, Kanagawa (JP); Masahiro Akatsuka, Kanagawa (JP); Yasuhiro Kato, Kanagawa (JP); Takayuki Ukawa, Kanagawa (JP); Shigeru Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/794,265

(22) Filed: Jul. 8, 2015

(30) Foreign Application Priority Data

Mar. 17, 2015 (JP) ..... 2015-052926

(51) Int. Cl.
*G03G 15/20* (2006.01)

(52) U.S. Cl.
CPC ..... *G03G 15/2085* (2013.01)

(58) Field of Classification Search
CPC ..... G03G 15/2032; G03G 15/2085
USPC ..... 399/67, 329
See application file for complete search history.

(56) References Cited

U.S. PATENT DOCUMENTS 8,295,725 B2 * 10/2012 Takahashi ..... G03G 15/2032 399/67
8,705,994 B2 * 4/2014 Inoue ..... G03G 15/2039 399/67
9,141,054 B2 * 9/2015 Sawamura et al. G03G 15/2032

FOREIGN PATENT DOCUMENTS

JP 2006-162999 A 6/2006
JP 2012-177789 A 9/2012

* cited by examiner

*Primary Examiner* — William J Royer
(74) *Attorney, Agent, or Firm* — Sughrue Mion, PLLC

(57) ABSTRACT

A fixing device includes a first rotary member; a second rotary member that is in contact with the first rotary member and presses a recording medium passing therethrough; a heating member that heats a contact area; a first support member supporting the first rotary member from inside so as to be in contact with the second rotary member; a second support member supporting the first support member and switchable between states in which it is in contact with and separated from the first support member; a first urging-force applying member attached to the second support member and urging the second and first support members against the second rotary member; a second urging-force applying member disposed between the first and second support members; and a switching member via which the first and second support members are switched between states in which they are in contact with and separated from each other.

5 Claims, 9 Drawing Sheets

FIXING DEVICE, IMAGE FORMING APPARATUS, PRESSING DEVICE, AND URGING DEVICE

CROSS-REFERENCE TO RELATED APPLICATIONS

This application is based on and claims priority under 35 USC 119 from Japanese Patent Application No. 2015-052926 filed Mar. 17, 2015.

BACKGROUND

Technical Field

The present invention relates to a fixing device, an image forming apparatus, a pressing device, and an urging device.

SUMMARY

According to an aspect of the invention, there is provided a fixing device including a first rotary member; a second rotary member that is in contact with a circumferential surface of the first rotary member, forming a contact area, and applies pressure to a recording medium passing through the contact area; a heating member that heats the contact area; a first support member provided inside the first rotary member and supporting the first rotary member so as to be in contact with the second rotary member; a second support member supporting the first support member and switchable between a state in which the second support member is in contact with the first support member and a state in which the second support member is separated from the first support member by a distance; a first urging-force applying member attached to the second support member and urging the first support member and the second support member against the second rotary member; a second urging-force applying member disposed between the first support member and the second support member; and a switching member via which the first support member and the second support member are switched between a state in which the first support member and the second support member are in contact with each other and a state in which the first support member and the second support member are separated from each other by a distance.

BRIEF DESCRIPTION OF THE DRAWINGS

Exemplary embodiments of the present invention will be described in detail based on the following figures, wherein.

DETAILED DESCRIPTION

Embodiments of the present invention will be described below with reference to the drawings.

Figure 1:
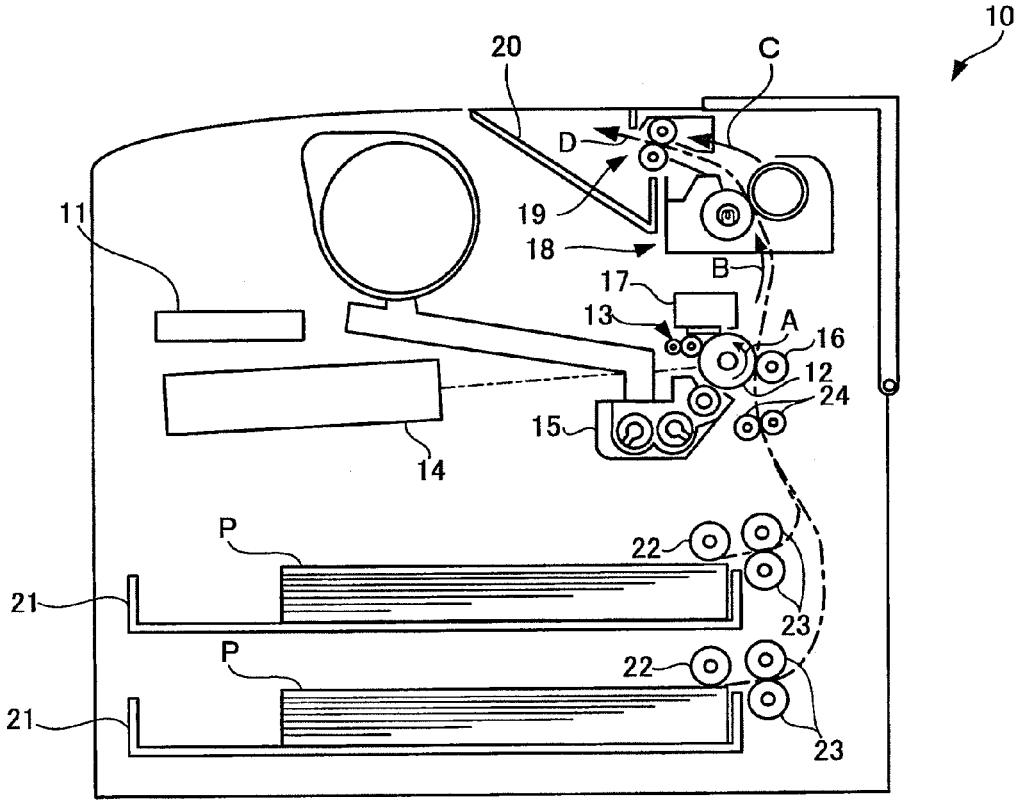
FIG. 1 is a schematic diagram of a printer, serving as an exemplary embodiment of an image forming apparatus of the present invention.

FIG. 1 is a schematic diagram of a printer, serving as an exemplary embodiment of an image forming apparatus of the present invention.

FIG. 1 shows a monochrome printer 10. An image signal representing an image and generated outside the printer 10 is input to the printer 10 via a signal cable (not shown) or the like. The printer 10 includes a controller 11 that controls the operation of components in the printer 10, and the image signal is input to this controller 11. The printer 10 forms an image according to the image signal, under control by the controller 11.

The printer 10 includes sheet trays 21 at the bottom, and the sheet trays 21 each accommodate a stack of sheets P. The sheet trays 21 are configured to be detachable, so that sheets P may be supplied. The sheet trays 21 may accommodate OHP sheets, plastic paper, envelopes, etc., serving as recording media in the present invention, instead of paper sheets P. Although the operation of the printer 10 accommodating paper sheets P will be described with reference to FIG. 1, the operation of the printer 10 accommodating another recording media is basically the same.

A sheet P in the sheet trays 21 is sent to stand-by rollers 24 via a pick-up roller 22 and separating rollers 23. The stand-by rollers 24 further transport the sheet P after adjusting the transportation timing.

This printer 10 includes a cylindrical photosensitive member 12 that revolves in an arrow A direction, above the stand-by rollers 24. Around the photosensitive member 12 are a charger 13, an exposure unit 14, a developing unit 15, a transfer unit 16, and a photosensitive member cleaner 17. The photosensitive member 12, the charger 13, the exposure unit 14, the developing unit 15, and the transfer unit 16 together serve as an example of a forming unit of the present invention.

The charger 13 charges the surface of the photosensitive member 12, and the exposure unit 14 irradiates the surface of the photosensitive member 12 with light according to an image signal sent from the controller 11 to form an electrostatic latent image. The electrostatic latent image is developed by the developing unit 15 into a toner image.

The stand-by rollers 24 feed the sheet P such that the sheet P reaches a position facing the transfer unit 16, when the toner image on the photosensitive member 12 reaches that position. The toner image on the photosensitive member 12 is transferred to the sheet P by the transfer unit 16. In this way, an unfixed toner image is formed on the sheet P.

The sheet P having the unfixed toner image formed thereon is further transported in the arrow B direction and is subjected to heat and pressure in the fixing unit 18. Thus, the toner image is fixed to the sheet P. As a result, an image (i.e., the fixed toner image) is formed on the sheet P. The fixing unit 18 is an exemplary embodiment of the fixing device and pressing device of the present invention.

The sheet P passing through the fixing unit 18 advances in the arrow C direction toward an output unit 19 and is transported further in the arrow D direction by the output unit 19 onto an output tray 20.

Figure 2:
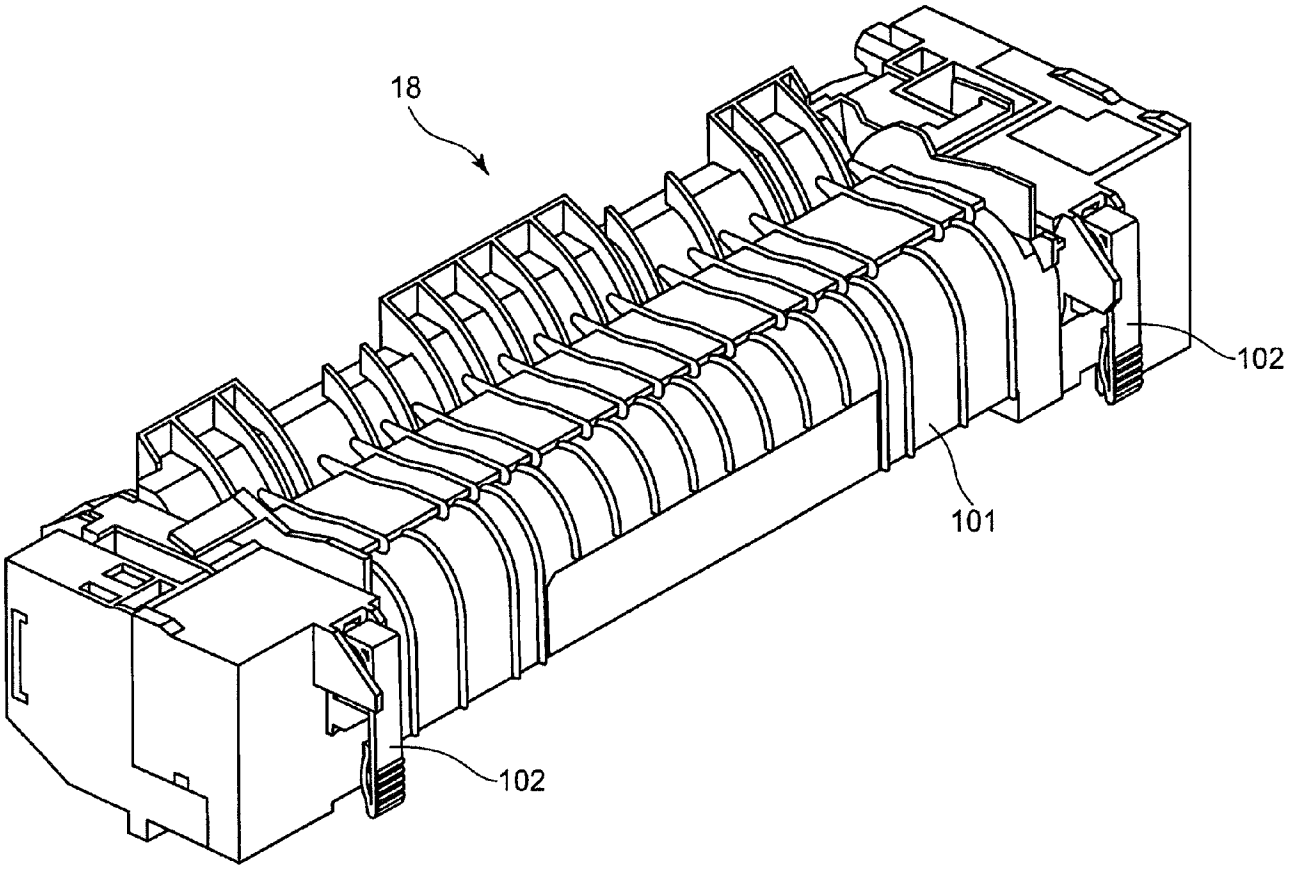
FIG. 2 is a perspective view showing an exterior of a fixing unit.

FIG. 2 is a perspective view showing the exterior of the fixing unit 18.

The internal components of the fixing unit 18 are covered by a covering part 101. The fixing unit 18 has switching levers 102 via which a user switches the force applied to a recording medium from outside the covering part 101.

Figure 3:
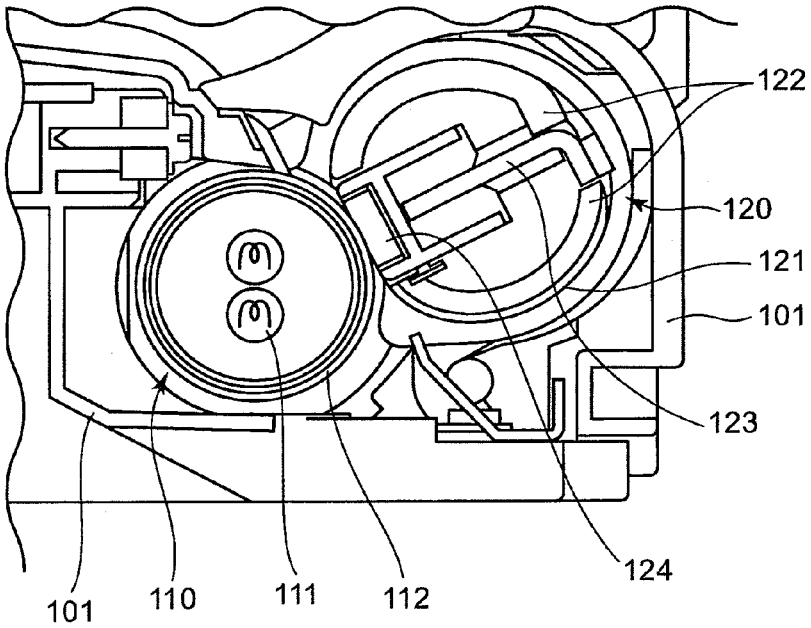
FIG. 3 is a sectional view taken in the middle of the fixing unit.

FIG. 3 is a sectional view taken in the middle of the fixing unit 18.

Inside the covering part 101 of the fixing unit 18 is a heating roller 110 and a pressure member 120. The pressure member 120 is an example of a first rotary member of the present invention, and the heating roller 110 is an example of a second rotary member of the present invention.

The heating roller 110 has heating lamps 111 therein, and an outer circumferential member 112, which is formed of a metal core and a rubber member provided thereon, is rotated. The heating lamps 111 are an example of a heating member of the invention.

The pressure member 120 includes an outer circumferential belt 121. Inside the outer circumferential belt 121 are guides 122, a support plate 123, and a pressure pad 124. The guides 122 are made of plastic and guide revolution of the outer circumferential belt 121.

The pressure pad 124 presses the outer circumferential belt 121 from inside to urge the outer circumferential belt 121 against the heating roller 110. Due to the recording medium passing through a contact area (nip area) where the outer circumferential belt 121 is sandwiched between the pressure pad 124 and the heating roller 110 and is urged against the outer circumference of the heating roller 110, the recording medium is pressed and heated.

The support plate 123 is made of metal and supports the internal components of the pressure member 120 in an integrated manner. Due to a force toward the heating roller 110 is applied to the support plate 123, a pressing force via the pressure pad 124 and the outer circumferential belt 121 is generated. The support plate 123 is an example of a first support member of the present invention.

Figure 4:
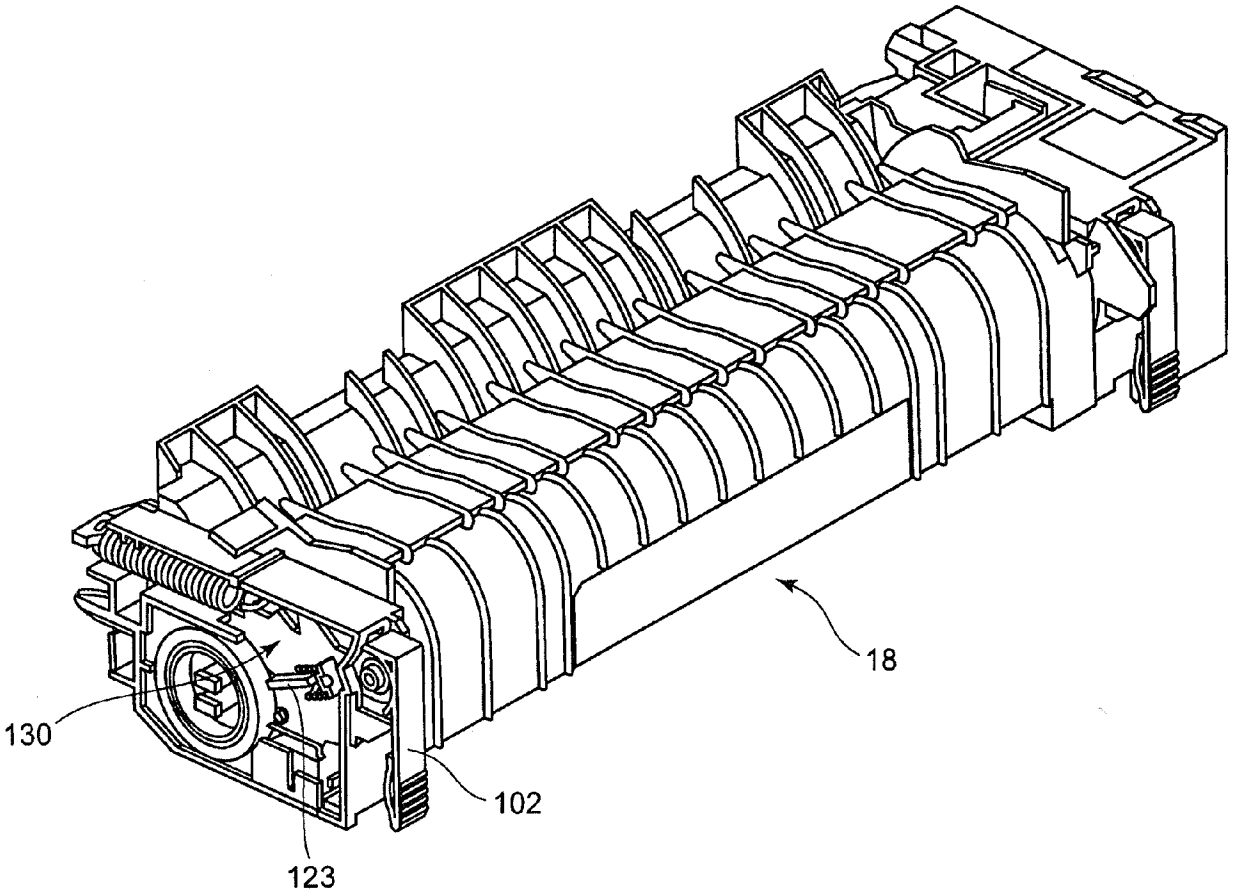
FIG. 4 is a perspective view of the fixing unit, showing a section at an end.

FIG. 4 is a perspective view of the fixing unit 18, showing a section at an end.

FIG. 4 shows a section of the fixing unit 18, taken at one of the switching levers 102. The support plate 123 extends to the end of the fixing unit 18. An urging mechanism 130 that urges the pressure member 120 against the heating roller 110 via the support plate 123 is mounted to the end of the fixing unit 18. The urging mechanism 130 is an example of an urging device of the present invention.

Figure 5:
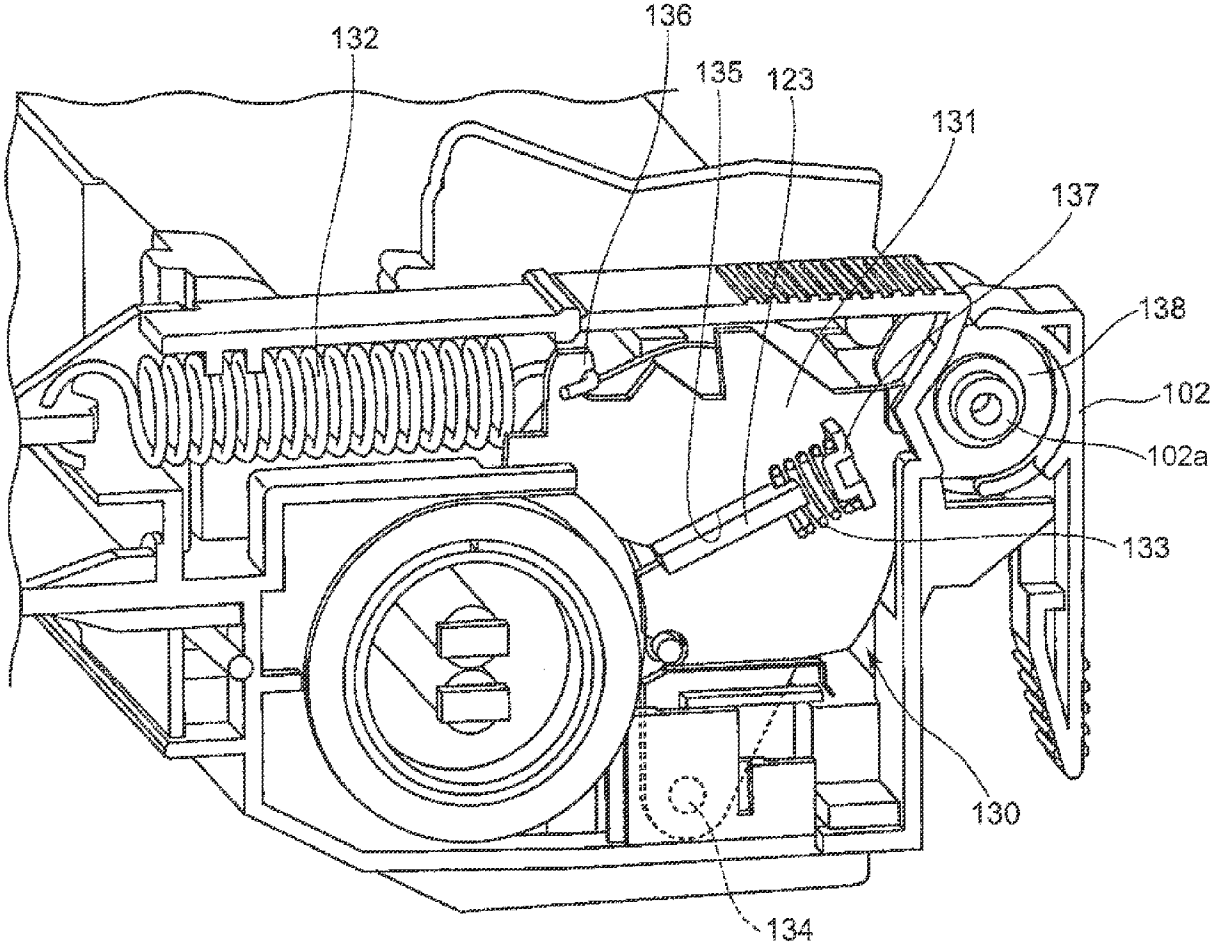
FIG. 5 shows a detailed structure of an urging mechanism.

FIG. 5 shows a detailed structure of the urging mechanism 130.

The urging mechanism 130 includes an urging plate 131, a normal-mode spring 132, an envelope-mode spring 133, and the switching lever 102 shown in FIG. 2. The urging plate 131 is an example of a second support member of the present invention, the normal-mode spring 132 is an example of a first urging-force applying member of the present invention, the envelope-mode spring 133 is an example of a second urging-force applying member of the present invention, and the switching lever 102 is an example of a switching member of the present invention. The urging-force applying members may apply urging forces to target objects either by pulling or pushing them, and the methods of applying the urging forces are not limited to those described in this embodiment.

The urging plate 131 is rotatable about a fulcrum 134 and has a guide groove 135 that guides the support plate 123 disposed therein. The urging plate 131 has a spring catch portion 136 that catches one end of the normal-mode spring 132, a spring retainer 137 that retains one end of the envelope-mode spring 133, and a lever retaining portion 138 that rotatably retains a fulcrum 102*a* of the switching lever 102.

The normal-mode spring 132 is an extension spring and urges the urging plate 131 to the left in FIG. 5. The envelope-mode spring 133 is a compression spring having a smaller spring constant than the normal-mode spring 132. The envelope-mode spring 133 is fitted between the spring retainer 137 of the urging plate 131 and the support plate 123 disposed in the guide groove 135 and urges the support plate 123 to the lower left in FIG. 5.

The thus-configured urging mechanism 130 is compact because the envelope-mode spring 133 is fitted between the support plate 123 and the spring retainer 137. In addition, the structure is simple because minimum parts are attached to the urging plate 131.

The operation of the urging mechanism 130 in the normal mode and in the envelope mode will be described below.

The urging mechanism 130 shown in FIG. 5 is in the normal mode, in which the switching lever 102 points down.

Figure 6:
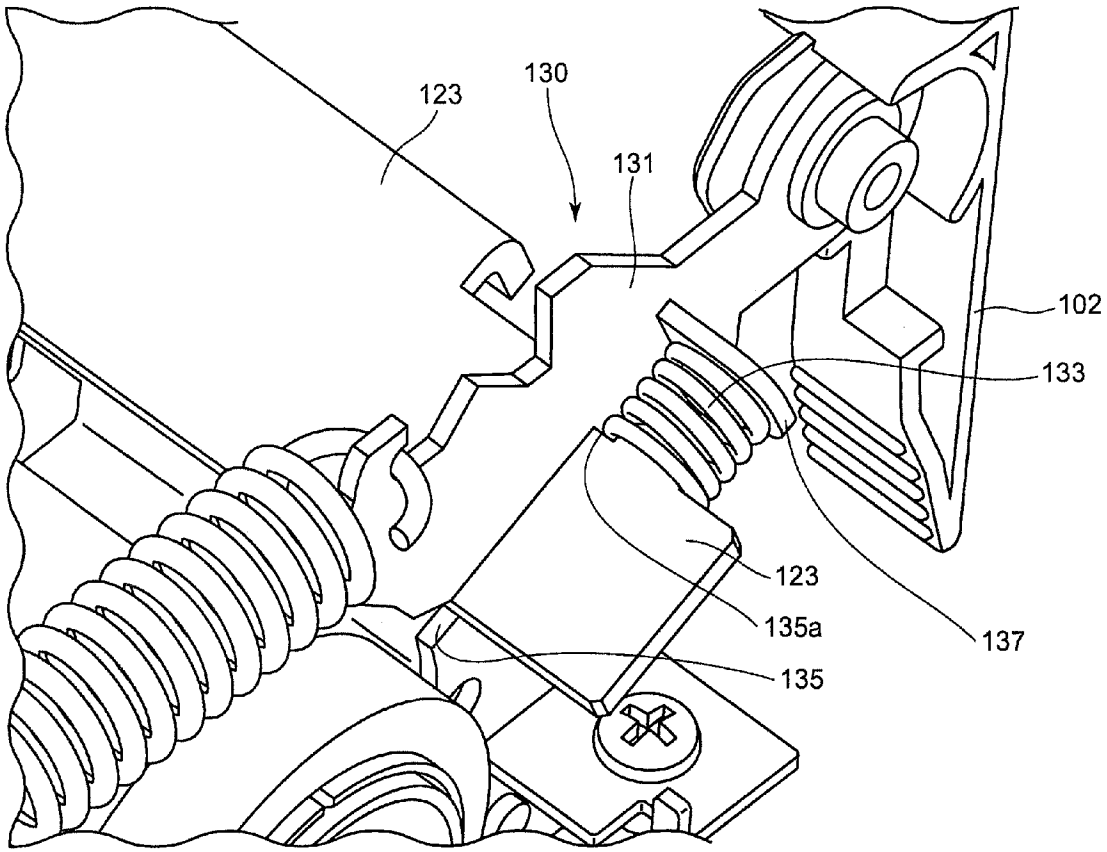
FIG. 6 is an enlarged view showing the states of components of the urging mechanism in a normal mode.

FIG. 6 is an enlarged view showing the states of the components of the urging mechanism 130 in the normal mode. FIGS. 5 and 6 will be described together below.

When the switching lever 102 points down in FIGS. 5 and 6, the urging plate 131 is rotatable about the fulcrum 134, and, due to the urging plate 131 being pulled to the left in FIG. 5 (lower left in FIG. 6) by the normal-mode spring 132, a bottom 135*a* of the guide groove 135 is in contact with the support plate 123. As a result, a strong force produced by the urging force of the normal-mode spring 132 is applied to the support plate 123, pressing the recording medium with a strong pressing force in the above-described nip area.

At this time, the envelope-mode spring 133 does not exert any urging force because the distance between the spring retainer 137 and the support plate 123 at both ends does not change.

When the switching lever 102 is lifted upward in FIGS. 5 and 6, the urging mechanism 130 is switched to the envelope mode.

Figure 7:
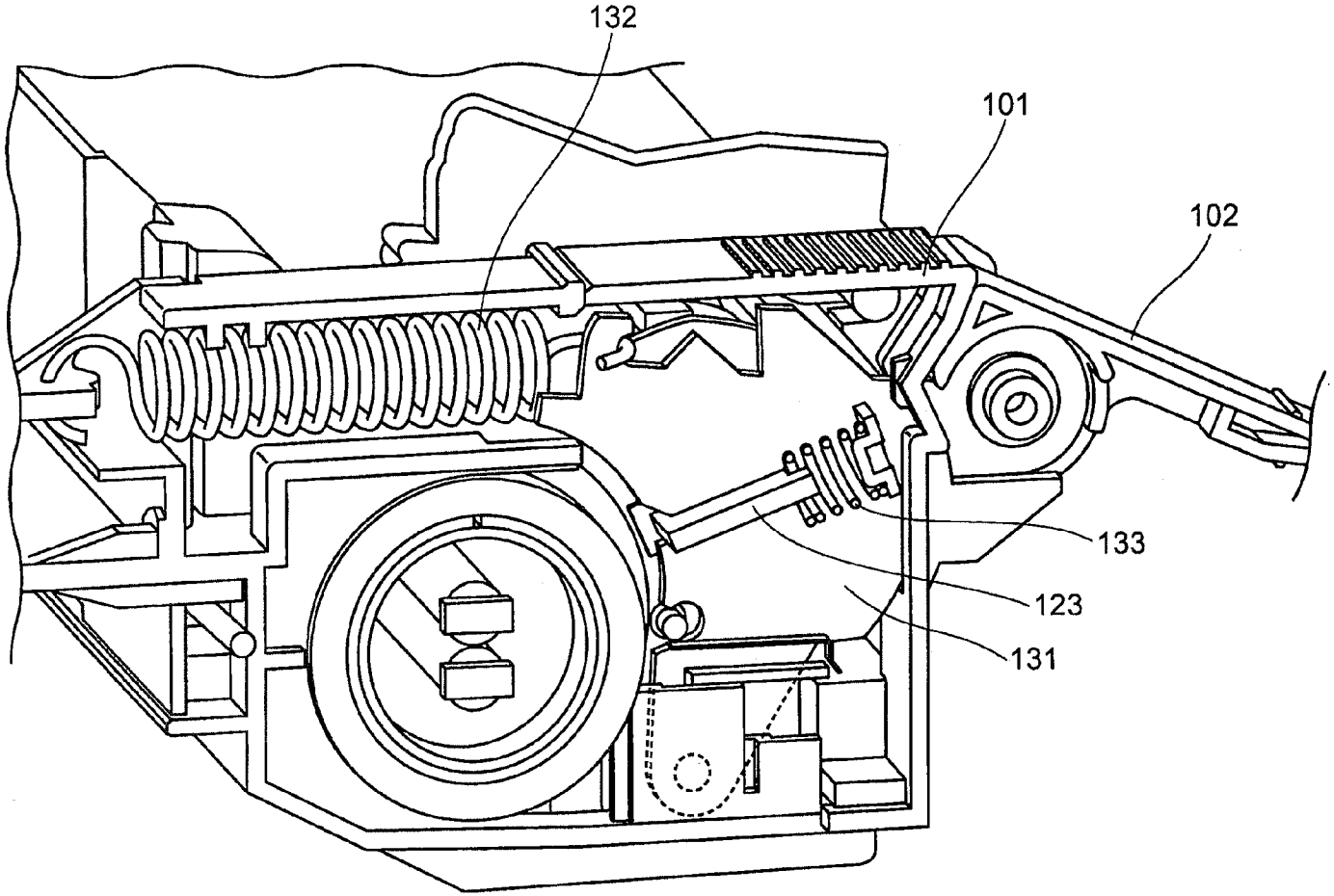
FIG. 7 shows the urging mechanism in an envelope mode.
Figure 8:
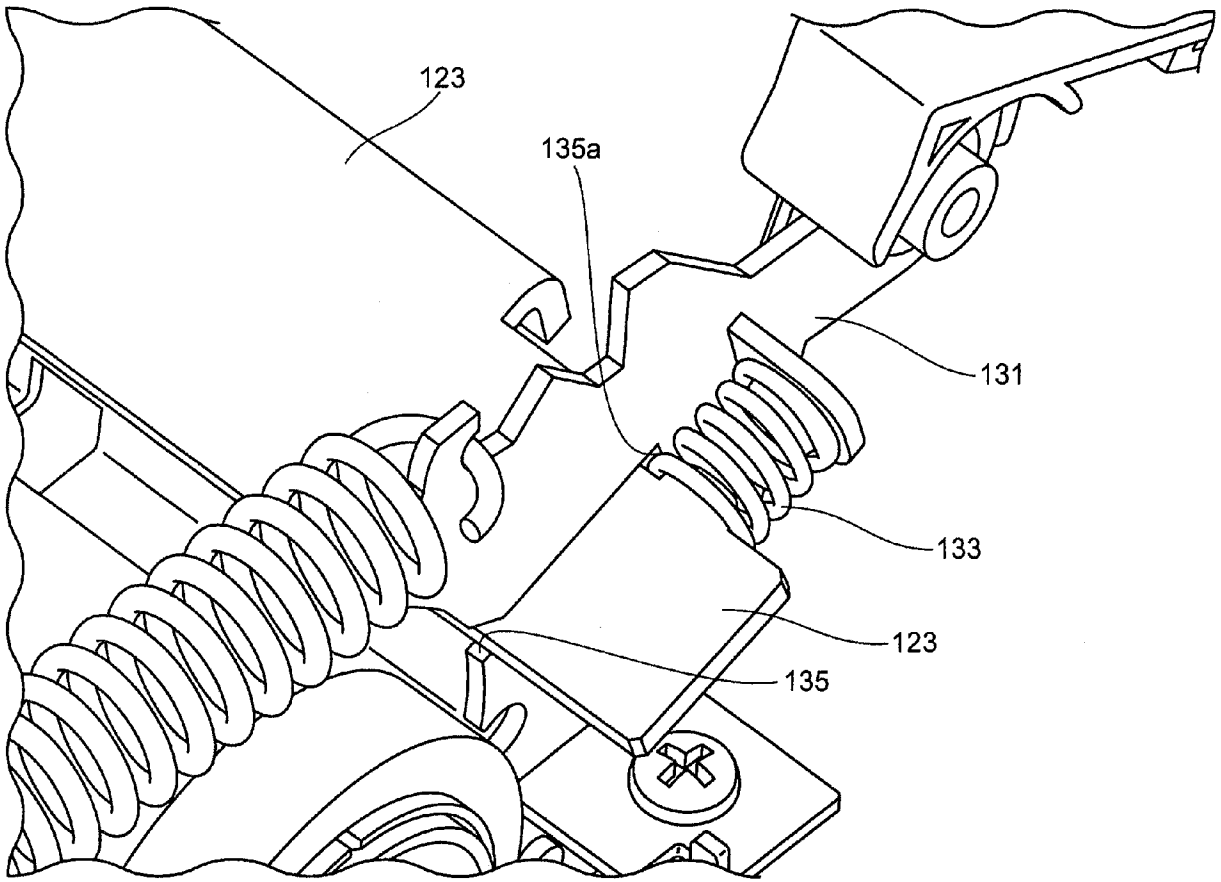
FIG. 8 is an enlarged view showing the states of components of the urging mechanism in the envelope mode.

FIG. 7 shows the urging mechanism 130 in the envelope mode, and FIG. 8 is an enlarged view showing the states of the components of the urging mechanism 130 in the envelope mode.

When the switching lever 102 is lifted upward, the urging plate 131 moves to the right in FIG. 7 (upper right in FIG. 8), and the switching lever 102 comes into contact with the outer surface of the covering part 101. As a result, the position of the urging plate 131 relative to the covering part 101 is fixed. At this time, the urging force of the normal-mode spring 132 serves to keep the urging plate 131 fixed to the covering part 101 via the switching lever 102 and is not transmitted to the support plate 123.

Due to the movement of the urging plate 131, the support plate 123 is separated from the bottom 135*a* of the guide groove 135, and as a result, the support plate 123 is urged against the spring retainer 137 of the urging plate 131 by the urging force of the envelope-mode spring 133. In the nip area, the recording medium is pressed by a pressing force that is weaker than that in the normal mode, produced by the urging force of the envelope-mode spring 133.

In this way, in this embodiment, the urging mechanism 130 is made compact and simple, and consequently, the fixing unit 18 and the printer 10 are made compact and simple, while enabling switching of the pressing force between the normal and envelope modes. Because switching between the normal and envelope modes is achieved by switching between the states in which the support plate 123 and the urging plate 131 are in contact with each other and in which the support plate 123 and the urging plate 131 are separated by a distance, high precision is unnecessary, and thus, the design and assembly of the switching levers 102 and the vicinity thereof are easy.

Next, another exemplary embodiment will be described. The other exemplary embodiment described below differs from the above-described embodiment only in part of the structure of the urging mechanism, so, overlapping descriptions will be omitted.

Figure 9:
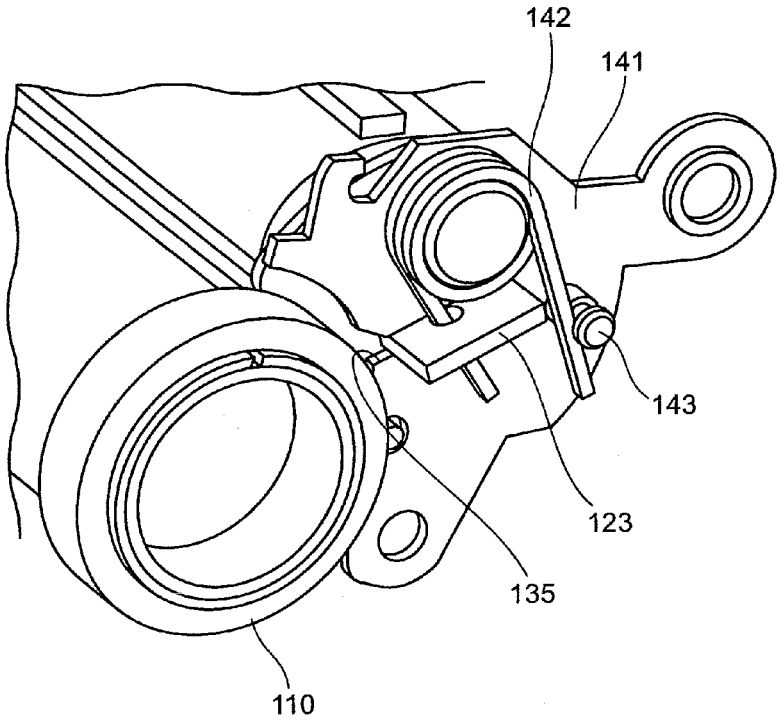
FIG. 9 shows part of the structure of the urging mechanism according to another exemplary embodiment.

FIG. 9 shows part of the structure of the urging mechanism according to another exemplary embodiment.

As shown in FIG. 9, an urging plate 141 according to this embodiment is substantially the same as that according to the above-described embodiment, but an envelope-mode spring 142 is a torsion spring. One end of the envelope-mode spring 142 is retained by a spring retainer 143 of the urging plate 141, and the other end of the envelope-mode spring 142 passes through a hole provided in the support plate 123. This hole is provided on the heating roller 110 side of the support plate 123 with respect to the center thereof, so, the urging force of the envelope-mode spring 142 is applied to a position closer to the heating roller 110. As a result, the support plate 123 moves in the guide groove 135 so as to be pulled by the urging force of the envelope-mode spring 142, and hence, the support plate 123 is less likely to be tilted relative to the guide groove 135 and is smoothly guided by the guide groove 135.

The description of the embodiments of the present invention is completed.

Although the above-described embodiments show the examples in which a user manipulates the levers to switch between the normal and envelope modes, the normal mode and the envelope mode are electrically switched.

Furthermore, although the fixing unit has been shown as an exemplary embodiment of the pressing device of the present invention, the pressing device of the present invention may be applied to a device that straightens a curled sheet.

Furthermore, although the monochrome printer has been shown as an example in the above-described embodiments, the present invention may be applied to color printers, facsimile machines, copiers, and multi-function machines.

Furthermore, although the apparatus that forms a toner image by using an electrophotographic system has been shown in the above-described embodiments, the forming unit of the present invention may form a toner image on a recording medium by using a method other than the electrophotographic system.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first rotary member;

a second rotary member that is in contact with a circumferential surface of the first rotary member, forming a contact area, and applies pressure to a recording medium passing through the contact area;

a heating member that heats the contact area;

a first support member provided inside the first rotary member and supporting the first rotary member so as to be in contact with the second rotary member;

a second support member supporting the first support member and switchable between a state in which the second support member is in contact with the first support member and a state in which the second support member is separated from the first support member by a distance;

a first urging-force applying member attached to the second support member and urging the second support member and the first support member against the second rotary member;

a second urging-force applying member disposed between the first support member and the second support member; and a switching member via which the first support member and the second support member are switched between a state in which the first support member and the second support member are in contact with each other and a state in which the first support member and the second support member are separated from each other by a distance.

2. The fixing device according to claim 1, wherein the second support member has a guide groove extending in a direction in which the second urging-force applying member urges the first support member, wherein the first support member extends in a direction in which the first rotary member is urged against the second rotary member, and wherein the second urging-force applying member urges the first support member, at a position closer to the second rotary member than a center thereof, in a direction in which an urging force is applied.

3. An image forming apparatus comprising:

a forming unit that forms an unfixed image on a recording medium;

a first rotary member;

a second rotary member that is in contact with a circumferential surface of the first rotary member, forming a contact area, and applies pressure to a recording medium passing through the contact area;

a heating member that heats the contact area;

a first support member provided inside the first rotary member and supporting the first rotary member so as to be in contact with the second rotary member;

a second support member supporting the first support member and switchable between a state in which the second support member is in contact with the first support member and a state in which the second support member is separated from the first support member by a distance;

a first urging-force applying member attached to the second support member and urging the second support member and the first support member against the second rotary member;

a second urging-force applying member disposed between the first support member and the second support member; and a switching member via which the first support member and the second support member are switched between a state in which the first support member and the second support member are in contact with each other and a state in which the first support member and the second support member are separated from each other by a distance.

4. A pressing device comprising:

a first rotary member;

a second rotary member that is in contact with a circumferential surface of the first rotary member, forming a contact area, and applies pressure to a recording medium passing through the contact area;

a first support member provided inside the first rotary member and supporting the first rotary member so as to be in contact with the second rotary member;

a second support member supporting the first support member and switchable between a state in which the second support member is in contact with the first support member and a state in which the second support member is separated from the first support member by a distance;

a first urging-force applying member attached to the second support member and urging the second support member and the first support member against the second rotary member;

a second urging-force applying member disposed between the first support member and the second support member; and a switching member via which the first support member and the second support member are switched between a state in which the first support member and the second support member are in contact with each other and a state in which the first support member and the second support member are separated from each other by a distance.

5. An urging device comprising:

a first support member that is disposed inside a first rotary member, among the first rotary member and a second rotary member that is in contact with a circumferential surface of the first rotary member, forming a contact area, and applies pressure to a recording medium passing through the contact area, and that supports the first rotary member so as to be in contact with the second rotary member;

a second support member supporting the first support member and switchable between a state in which the second support member is in contact with the first support member and a state in which the second support member is separated from the first support member by a distance;

a first urging-force applying member attached to the second support member and urging the second support member and the first support member against the second rotary member;

a second urging-force applying member disposed between the first support member and the second support member; and a switching member via which the first support member and the second support member are switched between a state in which the first support member and the second support member are in contact with each other and a state in which the first support member and the second support member are separated from each other by a distance.

* * * * *